United States Patent [19]

Weaver et al.

[11] Patent Number: 4,914,341

[45] Date of Patent: Apr. 3, 1990

[54] REFRIGERATOR CABINET CONSTRUCTION

[75] Inventors: Douglas E. Weaver; Roger D. Chapin, both of Greenville, Mich.

[73] Assignee: White Consolidated Industries, Inc., Cleveland, Ohio

[21] Appl. No.: 327,752

[22] Filed: Mar. 23, 1989

[51] Int. Cl.[4] ..... A47B 81/00

[52] U.S. Cl. ..... 312/214

[58] Field of Search ..... 312/214, 236; 220/22, 220/3

[56] References Cited

U.S. PATENT DOCUMENTS

| | | | |
|---|---|---|---|
| 3,813,137 | 5/1974 | Fellwock et al. . | |
| 3,858,409 | 1/1975 | Besing . | |
| 3,940,195 | 2/1976 | Tillman . | |
| 4,191,434 | 3/1980 | Powell et al. . | |
| 4,498,713 | 2/1985 | Fellwock et al. . | |
| 4,771,532 | 9/1988 | Taylor, Jr. et al. . | |
| 4,821,399 | 4/1989 | Markley | 312/214 X |

*Primary Examiner*—Joseph Falk

*Attorney, Agent, or Firm*—Pearne, Gordon, McCoy & Granger

[57] ABSTRACT

A refrigerator cabinet has a metal outer shell with a one-piece, thermoplastic inner liner having a peripheral flange received in a groove formed in the outer shell. Foamed-in-place insulation is used between the liner and the shell and the cabinet has a partition separating the interior of the liner into an upper freezer and lower fresh food compartment. The partition is supported by inwardly projecting ribs formed integrally with the liner extending around the back and two sides and terminating adjacent the peripheral flange. The peripheral flange in the area of the partition has an offset portion extending away from the front face, forming a curved portion which cooperates with the projecting ribs in providing vertical compliance of the liner during thermal expansion and contraction to reduce the possibility of stress cracking.

10 Claims, 4 Drawing Sheets

REFRIGERATOR CABINET CONSTRUCTION

BACKGROUND OF THE INVENTION

This invention relates generally to refrigerators, and more particularly to household refrigerators having a freezer compartment above a fresh food compartment.

Current household refrigerators have a cabinet construction that utilizes a relatively thin steel outer shell, together with a plastic inner liner with the space between being filled by an insulating polyurethane foam that is foamed in place to completely fill the insulation space. Generally, the inner liner is preferably formed from an acrylonitrile butadiene styrene copolymer, known as "ABS," because this plastic has desirable qualities of relatively high strength and hardness, together with excellent impact resistance, and its thermoplastic abilities lend themselves to thermoforming so that the entire liner may be fabricated from a single sheet of plastic. With this arrangement, the steel shell is generally formed to have a flat face at the front of the cabinet behind which the steel is formed into a reentrant groove, while the liner has a flange on its front face which fits into this groove to provide a relatively close fit and eliminate the need for any separate thermal breaker strips between the liner and shell.

If the inner surface of the steel is untreated or unprotected, the polyurethane foam tends to adhere rather strongly to the steel surface, and likewise the foam will adhere quite strongly to an untreated surface of ABS plastic. This feature results in a strong structural sandwich construction, giving a high degree of rigidity to the entire cabinet. However, such strong bonding of the foam creates a problem because the plastic liner has a much greater thermal coefficient of expansion than that of the steel shell. When the cabinet is formed, both the shell and liner are at a relatively high temperature of about 55° C., and after the cabinet cools, and particularly during shipping at low temperatures, the differential contractions between the shell and liner will produce stresses on the liner, which may then tend to crack and become damaged.

It has been recognize that some of the stress that is applied to the liner as a result of thermal expansion and contraction can be reduced by the application of release agents, such as waxes, or certain plastic material, such as polyethylene and polyvinyl acetate, that are nonadherent to the polyurethane foam. These materials are selectively applied to areas on both the liner and the outer shell, particularly at places of maximum stress, and the use of these coatings has generally reduced the problem. In addition, advantage is taken of the formability of the thermoplastic liner by forming inwardly projecting ribs or ridges on the liner to accommodate shelves and also to position the partition between the freezer compartment and lower food compartment. The presence of these ribs, particularly if coated with a release agent to prevent strong adherence of the polyurethane foam, allows the plastic liner to expand and contract vertically along what may be called "accordion" lines, which tends to greatly reduce the stress on the liner. Recognition of the above approaches to reduce liner stress is shown, for example, in U.S. Pat. Nos. 3,813,137; 3,858,409; 3,940,195; and 4,498,713.

However, it has been found that, while the above approaches do tend to reduce cracking throughout most of the liner, they are not effective to reduce the stresses on the liner around the front flange that fits into the groove in the outer shell. While it is noted that U.S. Pat. No. 4,191,434 shows a construction in which the front flange is recessed in a rectangular notch to receive a flange on the partition between the freezer and food compartments, such an arrangement is difficult to form and still results in sharp corners which tend to concentrate the thermal stress and, therefore, do not eliminate the cracking at the front flange.

One arrangement that does recognize this problem and provide a solution is shown in U.S. Pat. No. 4,771,532, in which an elongated slot is cut through the front flange and a portion of the side wall of the liner. While this arrangement does provide a certain amount of mechanical compliance for the liner for reduce thermal stress in this area, it is relatively expensive to form, since the liner must be cut away after forming, and the slot must be covered during the foaming operation to prevent the foam from entering into the interior of the liner.

SUMMARY OF THE INVENTION

The preferred embodiment of this invention provides an improved construction for a plastic liner in a refrigerator to reduce stress and cracking as a result of thermal expansion and contraction.

The invention is particularly adapted to refrigerators having a freezer section on top and fresh food compartment on the bottom, and in which the compartments are separated by a partition positioned and secured in place by means of projecting ribs and grooves formed in the plastic liner. In refrigerators of this type, there is a metal outer shell having a front edge which is folded to form a peripheral front facing flange behind which is a reentrant groove around the entire periphery of the front face. The liner is formed with an outwardly extending flange on the front face which fits within the groove and the space between the liner and the shell is filled with foamed-in-place insulation such as polyurethane foam. The front flange of the liner in the area of the partition between the two compartments is formed with a rearwardly extending, curved offset portion which is spaced away from the front flange of the shell in the area of the partition and the mullion. The curved offset portion on the front face includes a semicircular portion directly behind the mullion in the area of the ribs supporting the partition, together with smoothly curving portions above, below, and to the side of the semicircular portion. The provision of this curved offset portion on the front flange provides a limited amount of flexing or compliance on the flange area in approximately the same vertical zone as the ribs and grooves formed in the other walls of the liner. This limited amount of vertical thermal expansion in the front flange as well as the liner walls reduces the stress applied to the liner in the flange area as a result of thermal expansion and contraction, and therefore reduces the possibility of the liner's cracking in this area.

DESCRIPTION OF THE PREFERRED EMBODIMENT

Figure 2:
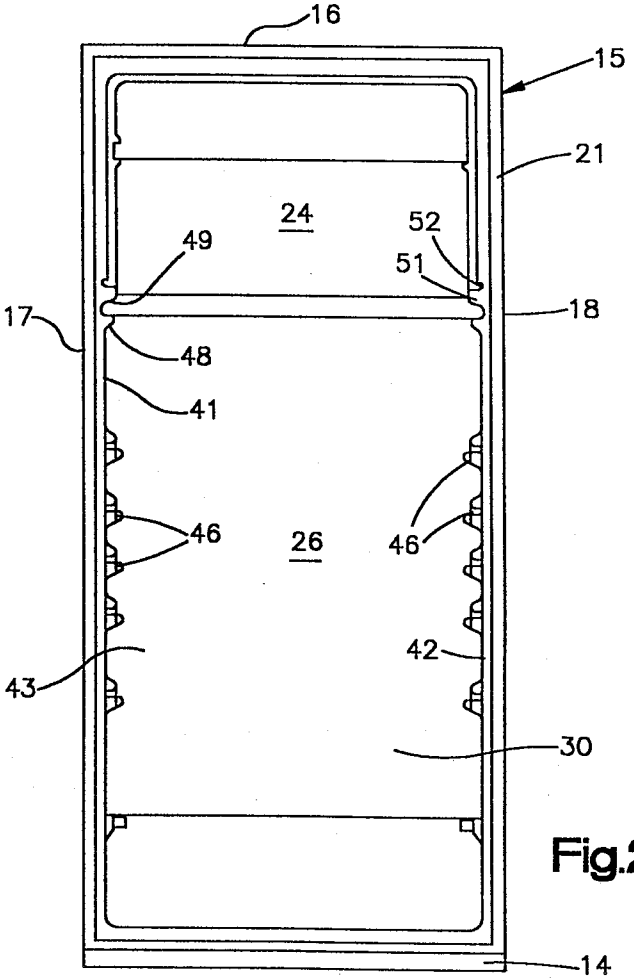
FIG. 2 is a front elevational view of the refrigerator shown in FIG. 1, with the partition and mullion removed.
Figure 1:
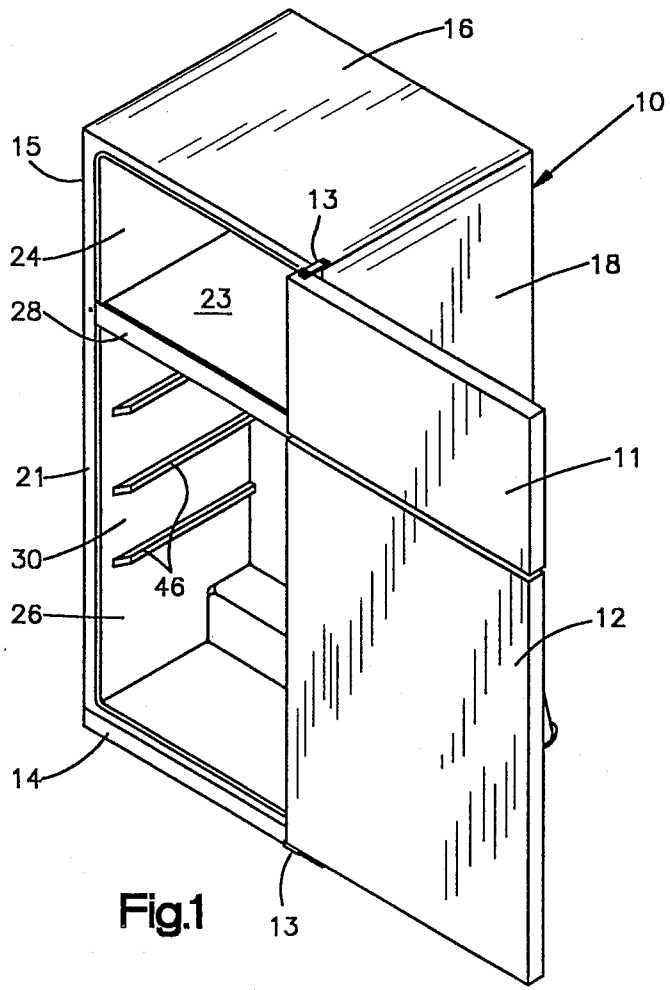
FIG. 1 is a perspective view of a top freezer, two-door refrigerator of the type incorporating the present invention, with the doors open.

Referring now to the drawings in greater detail, FIG. 1 shows a typical household refrigerator having a top-mounted freezer compartment. The refrigerator includes a cabinet 10 having an upper door 11 and lower door 12 mounted on hinges 13 secured to the sides of the cabinet. The cabinet includes an outer shell 15 formed of sheet metal such as steel mounted on a separate base 14, and the shell includes a top surface 16 together with left and right side walls 17 and 18, together with a bottom panel (not shown) which is secured to the base 4. The four sides of shell 15 have inturned edges at the front side which form a rectangular, planar front face 21 extending around all four sides of the refrigerator.

The interior of the refrigerator has a horizontal partition 23 separating an upper freezer compartment 24 from a lower fresh food compartment 26, and partition 23 extends forward to a horizontal mullion member 28 extending transversely between the two sides in the plane of the front face 21, serving as a seat for the door sealing gaskets (not shown) which make sealing engagement with both the mullion 28 and the front face 21.

Figures 4, 5, 6:
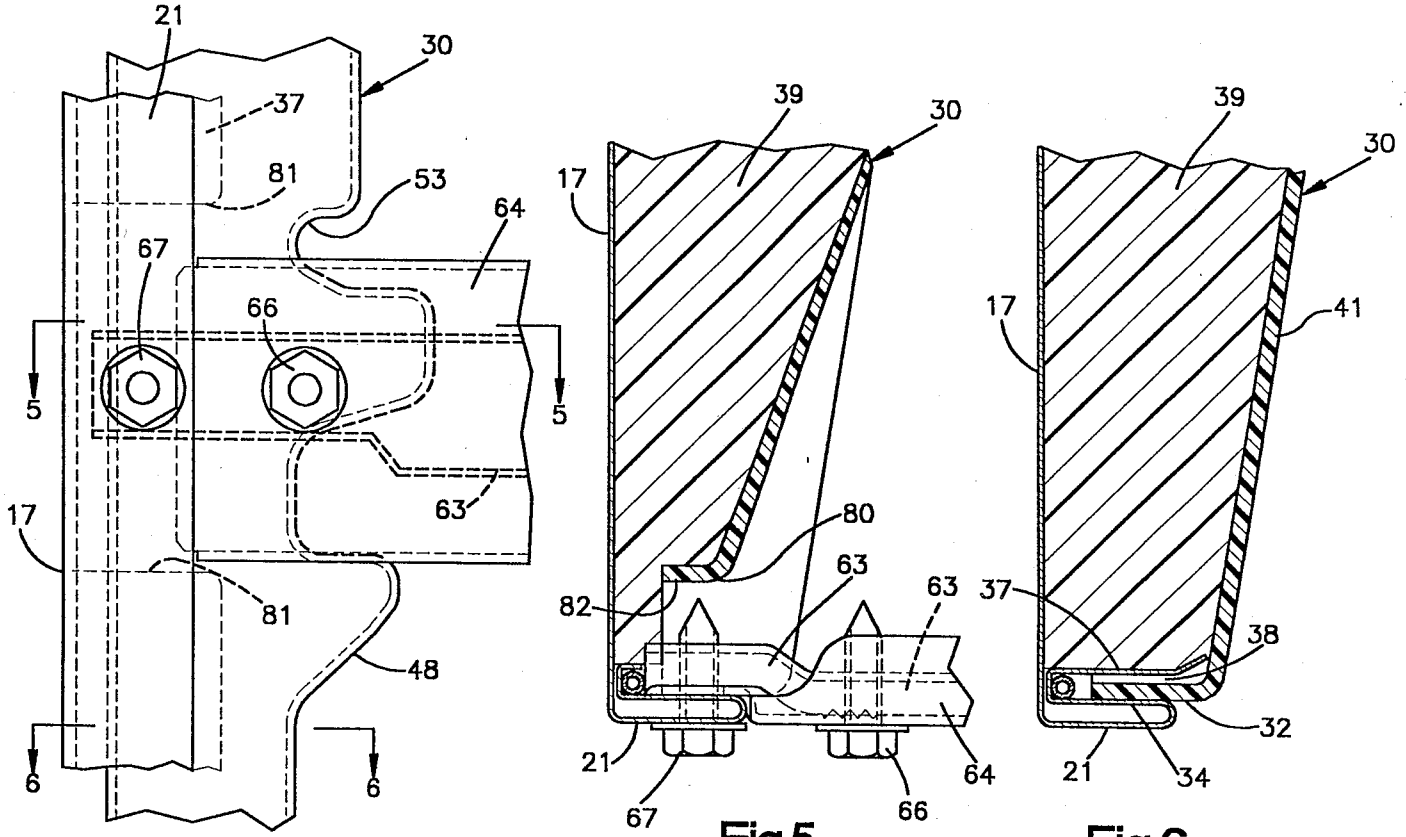
FIG. 4 is a fragmentary, elevational view of the mullion area of the refrigerator.
FIG. 5 is a cross-sectional view taken on line 5—5 of FIG. 4.
FIG. 6 is a cross-sectional view taken on line 6—6 of FIG. 4.
Figure 7:
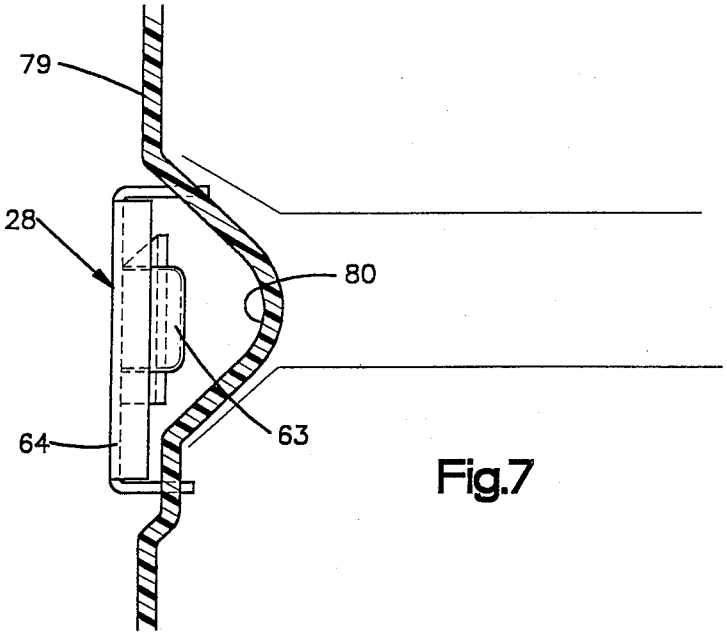
FIG. 7 is a fragmentary, cross-sectional view of curved offset portions of the liner flange.

The interior compartment of the refrigerator is defined by the liner 30 which forms all of the interior walls of the refrigerator and which is made of a suitable plastic material, such as acrylonitrile butadiene styrene copolymer known as "ABS" and which can be thermoformed from a single sheet of material. This material has a coefficient of thermal expansion of about eight times that of steel and the cabinet at times, such as during shipping, may be exposed to temperatures between −30° C. and +50° C. The liner 30 is mounted within the cabinet shell 15 by means of a peripheral flange 32 formed around all sides of the liner at its front face. The flange 32 is mounted in a groove behind the front face 21, where an extension of the sheet metal of the shell is bent to form a re-entrant flange 34 (see also FIG. 6) extending from an edge 35 back behind the front face 21 where, after another 180-degree bend, it terminates in a reversed flange 37 extending inwardly away from the shell to define a groove 38 within the flange 32 is received at all points around the periphery. While the groove 38 and flange 32 serve to position the liner within the shell, the space between the liner and shell is formed with a foamed-in-place polyurethane insulation 39 that serves to rigidly support the liner and provides stiffening for the relatively thin sheet metal of shell 15.

The liner is formed as a roughly rectangular box, with the one side open around peripheral flange 32, and therefore includes left and right side walls 41 and 42 joined together at the back by a back wall 43. In the area of the fresh food compartment 26, the side walls 41 and 42 may have formed in them horizontal shelf support ribs 46 which, in effect, form an inwardly projecting fold in the side wall. At the partition area, an inwardly projecting partition support rib 48 extends along both of the side walls 41 and 42 and around the back wall 43 for positioning and supporting the partition. A lower groove 49 is formed into these three walls directly above the support ribs, while an upper support rib 51 is formed along only the side walls 41 and 42. An upper groove 53 extends above the upper ribs 51 and 52 along the length of the walls 41 and 42, and these ribs and grooves are positioned to provide both positioning and support for the partition 23.

Figure 3:
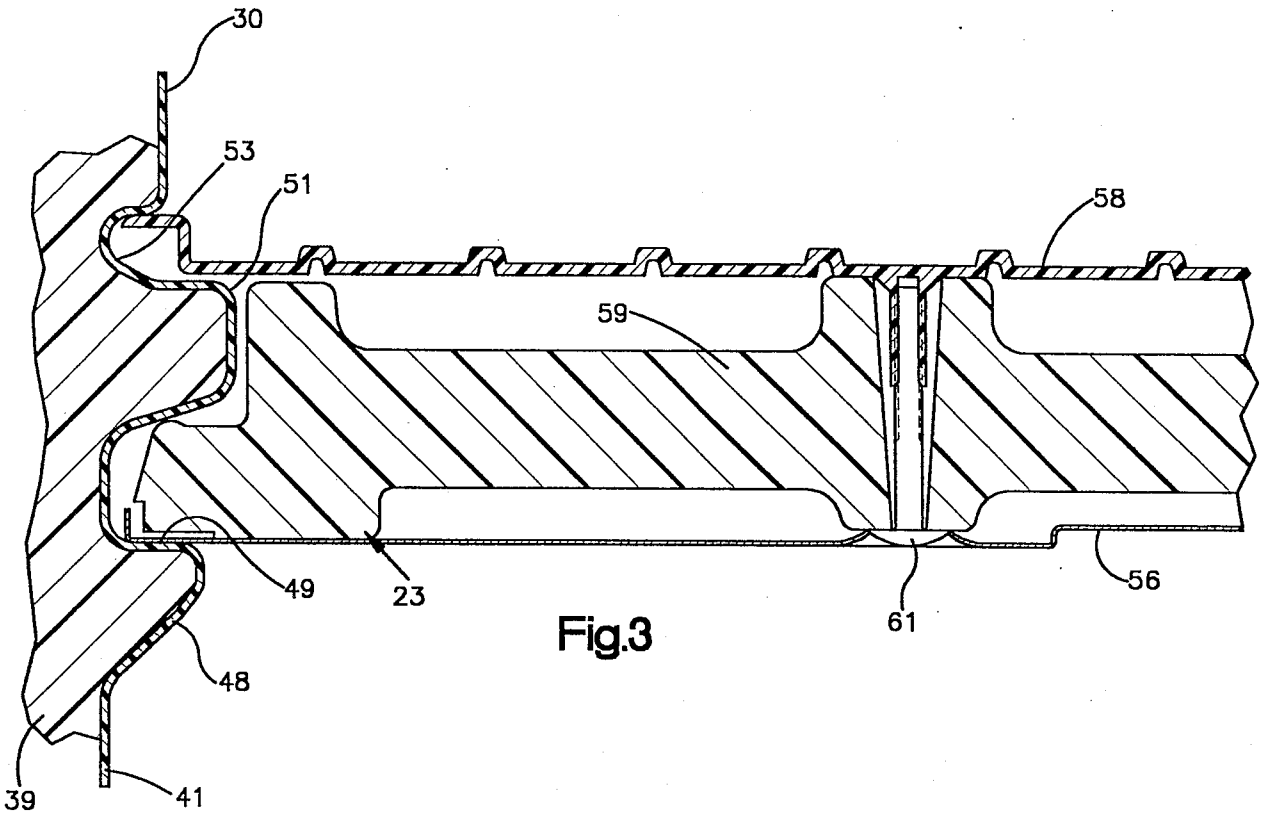
FIG. 3 is a fragmentary, cross-sectional view of the liner and partition behind the mullion.

As shown in FIG. 3, partition 23 includes a metal bottom panel 56 which fits within the lower groove 49 to rest on the upper surface of the partition support rib 48. The partition also includes a top panel 58, preferably formed of a suitable plastic material, which fits within the upper groove 53 to rest on top of the upper support 51. The two panels 56 and 58 are spaced apart by an insulated spacer 59, and the panels 56 and 58 are secured together by suitable fasteners 61 extending through the spacer 59 so that the partition is an integral subassembly that, during assembly, may simply be moved into place in the grooves 49 and 53.

During assembly, after the partition 23 is inserted in place, a mullion support strap 63 and a mullion face 64 are placed in front of the partition and held together at each side by an inner screw 66 extending through the mullion face 64 to threadedly engage the mullion support strap 63, while an outer screw 67 passes through the shell front face 61 and also engages the mullion support strap 63 to firmly clamp these members in position. It should be noted that screws 66 and 67 on the hinge side of the cabinet are used to mount an intermediate hinge member (not shown) which serves as the lower hinge for the upper door 11 and upper hinge for the lower door 12, and which is reversible from side to side by the user, if so desired.

Figure 8:
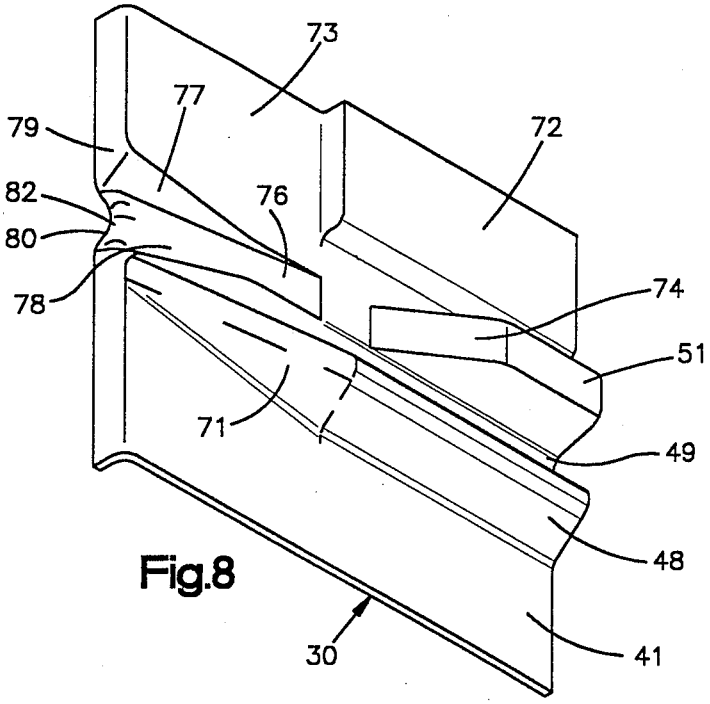
FIG. 8 is an enlarged, fragmentary, perspective view of the portion of liner at the partition area.

As is shown more clearly in FIG. 8, the partition support rib 48 and upper support rib 51 provides accordion-like folds in this area to accommodate thermal expansion and contraction of the liner 30 with respect to the rest of the cabinet. However, to allow the mounting of the liner within the groove 38, and to provide a generally unbroken edge around the liner at the peripheral flange 32, the partition support rib 48 has a tapered portion 71 at its forward edge so that the rib, in effect, disappears as it approaches the front face 79 of flange 32. The upper and lower grooves 49 and 53 are actually generally in the same plane as the interior surface of the liner wall 41, and therefore they merge into a flat portion 73 extending along the front edge of the liner except for an offset wall 72 in the freezer section which provides greater insulation thickness in that compartment. The upper support rib, which is generally aligned with the middle of the partition 23 in the area of the insulation spacer 59, has a sloping end 74 which merges into the flat portion 73 a spaced distance inwardly from the peripheral flange 32. However, just beyond the end of the sloping portion 74, a sloping groove 76 is formed in the liner, and groove 76 has a generally flattened bottom wall 78, together with outwardly flaring side walls 77 extending outward to merge into the peripheral flange 32 along its front face 79. The groove 76 joins a curved offset portion 80, in which the flange 32 curves backwards in a generally semicircular bend away from the front face 79. As noted in FIG. 4, to accommodate the curved portion 80, a gap 81 is formed in the reversed flange 37 on the shell wall (see also FIG. 5) so that the curved portion 81 has a relatively short, laterally extending face portion 82 of much lesser width than the width of the remainder of the peripheral flange face 79. There are no sharp edges or corners in this area and the face portion 82 also curves smoothly into the groove bottom wall 78. The curved portion 80 therefore allows the peripheral flange 32 to expand and contract vertically in this area. Thus, the curved portion 80 functions together with the ribs 48 and 51 to allow the liner to flex and bend without undue stress concentration at all points in the zone of the partition 23 extending from edge to edge across the liner. As a result of the mechanical compliance of the liner in this area, there are no concentrations of stress that are not compensated for in a vertical direction, and any possibility of cracks developing in the liner at this point from thermal stress is greatly reduced.

Although the preferred embodiment of this invention has been shown and described, it is recognized that various modifications and rearrangements may be made without departing from the scope of the invention as defined in the following claims.

What is claimed is:

1. A refrigerator cabinet comprising a shell having side walls, a top wall, and a bottom wall, said walls defining an opening and having inturned edges defining a face, said edges forming a channel behind said face, a liner within said shell having walls defining a chamber and having an outwardly extending flange received within said channel, a horizontal partition within said liner intermediate said top and bottom, said liner walls having at least one integrally formed rib projecting into said chamber adjacent said partition, a mullion on the front face of said partition extending between the edges of said side walls in vertical alignment with said partition, said liner flange having an offset portion extending horizontally away from said shell face in a zone adjacent said rib, said offset portion curving smoothly and having a semicircular portion of maximum horizontal displacement from said shell face at a point adjacent said mullion, said offset portion and said rib providing vertical compliance of said liner during thermal expansion and contraction.

2. A refrigerator cabinet as set forth in claim 1, wherein said flange has a width in said offset portion less than the width of said flange on either side of said offset portion.

3. A refrigerator cabinet as set forth in claim 2, wherein said liner wall has a groove adjacent said offset portion.

4. A refrigerator cabinet as set forth in claim 3, wherein said groove tapers and decreases in depth in a direction of away from said offset portion.

5. A refrigerator cabinet as set forth in claim 4, wherein said groove is located a spaced distance from said rib.

6. A refrigerator cabinet as set forth in claim 5, wherein said rib has a tapered portion adjacent said flange decreasing in size toward said flange.

7. A refrigerator cabinet comprising a shell having side walls, a top wall, and a bottom wall, said walls defining an opening and having inturned edges defining a face, said edges forming a channel behind said face, a liner within said shell having walls defining a chamber and having an outwardly extending peripheral flange received within said channel, a horizontal partition within said liner intermediate said top and bottom, said liner having top and bottom integrally formed ribs on said walls projection into said chamber above and below said partition to secure said partition in place, a mullion on the front face of said partition extending between the edges of said side walls in vertical alignment with said partition, said liner flange having an offset portion extending horizontally away from said shell face in a zone between said top and bottom ribs, said offset portion curving smoothly and having a semicircular portion of maximum horizontal displacement from said shell face at a point adjacent the vertical midpoint of said mullion so that said mullion and said partition substantially cover said offset portion and said offset portion and said ribs provide a vertical compliance of said liner during thermal expansion and contraction.

8. A refrigerator cabinet as set forth in claim 7, wherein said liner flange has a width in said offset portion less than the width of said liner flange on either side of said offset portion.

9. A refrigerator cabinet as set forth in claim 8, wherein said liner wall has a groove adjacent said offset portion in alignment with said top rib.

10. A refrigerator cabinet as set forth in claim 9, wherein said top rib terminate a spaced distance from said flange and said groove tapers and decreases in depth in a direction away from said offset portion to terminate a spaced distance from said top rib.

* * * * *